US006798245B2

(12) United States Patent
Ohmae

(10) Patent No.: US 6,798,245 B2
(45) Date of Patent: Sep. 28, 2004

(54) CURRENT MIRROR CIRCUIT

(75) Inventor: Hideo Ohmae, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 10/681,891

(22) Filed: Oct. 9, 2003

(65) Prior Publication Data

US 2004/0075489 A1 Apr. 22, 2004

(30) Foreign Application Priority Data

Oct. 21, 2002 (JP) ..... 2002-305387

(51) Int. Cl.[7] ..... G05F 3/24

(52) U.S. Cl. ..... 326/82; 326/83; 327/538; 327/543

(58) Field of Search ..... 326/82, 83, 112; 327/538, 540, 543, 545

(56) References Cited

U.S. PATENT DOCUMENTS 5,631,600 A * 5/1997 Akioka et al. ..... 327/543
6,496,057 B2 * 12/2002 Wada et al. ..... 327/543
6,639,456 B2 * 10/2003 Paulus ..... 327/545
6,646,496 B2 * 11/2003 Watanabe ..... 327/541

OTHER PUBLICATIONS

Razavi, Behzad. "Design of Analog CMOS Integrated Circuits" McGraw–Hill, 2001, Sec 18.2 Analog Layout Techniques, pp. 642–643.

* cited by examiner

*Primary Examiner*—Don Le
(74) *Attorney, Agent, or Firm*—Merchant & Gould P.C.

(57) ABSTRACT

A first input transistor of a current mirror, in which one end is connected to a first constant current source and another end is connected to a reference potential (for example, the ground), serves as a current mirror input. A second input transistor, in which one end is connected to a second constant current source, is disposed with being separated from the first input transistor by a predetermined distance. A plurality of output transistors is distributed between the first and second input transistors. The gate-source voltages of the output transistors are substantially equal to those of the first and second input transistors. Therefore, it is possible to provide to a current mirror circuit which has a large number of output transistors, an influence due to the wiring resistance of a feeder line are remarkably reduced without increasing the wiring area for forming the feeder line.

9 Claims, 8 Drawing Sheets

CURRENT MIRROR CIRCUIT

BACKGROUND OF THE INVENTION

1. Field of the Invention

The present invention relates to a current mirror circuit in an analog IC such as an LCD driver IC, which forms a large number of current sources placed in a wide area of an IC chip.

2. Description of the Related Art

In an analog IC, when many constant current sources are required, a current mirror circuit which forms a large number of constant current sources with using one constant current source as a reference is often used. FIG. 6A shows a conventional current mirror circuit which is usually used, and FIG. 6B is a characteristic diagram of the current mirror circuit of FIG. 6A.

Referring to FIG. 6A, a constant reference potential Vref is applied to the gate of a P-channel MOS field-effect transistor (hereinafter, "PMOS") Q0 to form a constant current source I61. A constant current Iref outputted from the constant current source I61 is supplied to an N-channel MOS field-effect transistor (hereinafter, "NMOS") Qref6 in which the drain and the gate are connected to each other and the source is connected to the ground GND. The NMOS Qref6 is used as an input transistor (i.e., a mirror source transistor) of the current mirror circuit, and NMOSs Q61 to Q6*n* are used as output transistors (i.e., mirror destination transistors). The sources of the output transistors Q61 to Q6*n* are connected to the source of the input transistor Qref6 through a feeder line Ws6. The gates of the output transistors Q61 to Q6*n* are connected to the gate of the input transistor Qref6 through a potential line Wp6. According to the configuration, the gate potentials of the output transistors Q61 to Q6*n* are equal to the gate potential of the input transistor Qref6. The figure "Vdd" denotes the power source potential.

Even when a conductor wire such as an aluminum wire is used as the feeder line Ws6, the feeder line has wiring resistance Rw to some extent. In the case where a large number of output transistors Q61 to Q6*n* are distributed in a wide range, the voltage drop due to the wiring resistance Rw and a current cannot be negligible. This state is shown in FIG. 6B.

Referring to FIG. 6, no current flows through the potential line Wp6, and hence the gate potentials of the output transistors Q61 to Q6*n* are equal to the gate potential of the input transistor Qref6. On the other hand, because of the voltage drop in the feeder line Ws6, the source potentials of the output transistors Q61 to Q6*n* are sequentially raised as moving along the placement positions of the output transistors Q61 to Q6*n*. As compared with the gate-source voltage Vgs of the input transistor Qref6, therefore, the gate-source voltages Vgs of the output transistors Q61 to Q6*n* are sequentially smaller as moving along the placement positions. As a result, depending on the placement position, each of the output transistors Q61 to Q6*n* is enabled to supply only a current of a level which is considerably different from a desired current level.

FIG. 7 shows a configuration in which feeder lines are arrange in a star-like shape in order to avoid the influence of the voltage drop caused by a feeder line. A constant current Iref output from a current source I71 is supplied to an NMOS Qref7 in which the drain and the gate are connected to each other. The NMOS Qref7 is used as an input transistor of a current mirror circuit, and NMOSs Q71 to Q7*n* are used as output transistors. The sources of the input transistor Qref7 and the output transistors Q71 to Q7*n* are connected to a common point K through feeder lines Ws7*r* and Ws71 to Ws7*n*, respectively, and then connected to the ground GND. According to the configuration, the gate-source voltages Vgs of the output transistors Q71 to Q7*n* are equal to the gate-source voltage Vgs of the input transistor Qref7.

FIG. 8 shows a configuration in which an interface based on a gate voltage is not produced and a current interface is realized in order to avoid the influence of the voltage drop caused by a feeder line (see the following document "Design of Analog CMOS Integrated Circuits"). In a current mirror circuit having the current interface configuration of FIG. 8, a plurality "n" of or PMOSs Q01 to Q0*n* are disposed in a current source I81, and a reference voltage Vref is commonly applied to the gates so that a constant current Iref is flown through each of the PMOSs Q01 to Q0*n*. The constant currents Iref are supplied to NMOSs Qref81 to Qref8*n* in each of which the drain and the gate are connected to each other, and which are input transistors, through feeder lines Ws81 to Ws8*n*, respectively. NMOSs Q81 to Q8*n* which are output transistors are connected to the input transistors Qref81 to Qref8*n* so as to constitute respective current mirror configurations. According to the configuration, regardless of the difference among lengths of the feeder lines Ws81 to Ws8*n*, i.e., different resistances, the same gate-source voltage Vgs is supplied to all the output transistors Q81 to Q8*n*. Therefore, a current of a desired level can be supplied.

Behzad Razavi, "Design of Analog CMOS Integrated Circuits" McGraw-Hill, 2001, Sec. 18.2 Analog Layout Techniques, p.p. 642–643 is known as a related document.

In the conventional current mirror circuit of the star arrangement shown in FIG. 7, the feeder lines must be individually prepared and set so as to have the same length which is equal to the length of the longest feeder line, in order to equalize the resistances of all the feeder lines Ws7*r* and Ws71 to Ws7*n*. In the current mirror circuit of the current interface configuration shown in FIG. 8, the feeder lines Ws81 to Ws8*n* whose number are equal to the number of the current mirror output transistors must be individually disposed, and the current mirror configurations each of which is configured by input and output transistors must be produced. In the current mirror circuits of the conventional configurations of FIGS. 7 and 8, when a large number of output transistors are disposed, therefore, a large wiring area is required for forming the feeder lines. In the case where hundreds of output transistors are used, such as in an LCD driver IC, a very large wiring area is required, and hence the chip size of the IC is increased.

SUMMARY OF THE INVENTION

An object of the invention is to provide a current mirror circuit which has a large number (such as hundreds) of output transistors, in which an influence due to the wiring resistance of a feeder line can be remarkably reduced without increasing the wiring area for forming the feeder line.

The invention provides a current mirror circuit, which has a plurality of output transistors serving as current mirror outputs, including: a first input transistor whose one end is connected to a first constant current source and whose another end is connected to a first connecting position at a first potential, which is used as an input side of a current mirror; a second input transistor whose one end is connected to a second constant current source, which is disposed with being separated from said first input transistor by a predetermined distance and is used as an input side of a current mirror; a first feeder line which connects said other end of said first input transistor with another end of said second input transistor; a first potential line which connects said one end of said first input transistor with said one end of said second input transistor with a resistance that is higher than a resistance of said first feeder line, to produce a potential gradient; and a plurality of output transistors distributed between said first input transistor and said second input transistor, which are coupled to said first feeder line and said first potential line and are used as an output side of a current mirror.

Moreover, the current mirror circuit further includes: a third input transistor whose one end is connected to a third constant current source, which is disposed with being separated from said second input transistor by a predetermined distance in an opposite direction to said first input transistor and is used as an input of a current mirror; a second feeder line which connects said other end of said second input transistor with another end of said third input transistor; a second potential line which connects said one end of said second input transistor with said one end of said third input transistor with a resistance that is higher than a resistance of said second feeder line, to produce a potential gradient; and a plurality of output transistors distributed between said second input transistor and said third input transistor, which are coupled to said second feeder line and said second potential line and is used as an output side of a current mirror.

Furthermore, said another end of said third input transistor is connected to a second connecting position at the first potential.

Furthermore, said first potential line is polysilicon line and said second first potential line is polysilicon line.

Furthermore, said first and second input transistors and said output transistors are P-channel MOS transistors and said third input transistor is also P-channel MOS transistor.

Furthermore, said first and second input transistors and said output transistors are N-channel MOS transistors and said third input transistor is also N-channel MOS transistor.

DETAILED DESCRIPTION OF THE PREFERRED EMBODIMENTS

Hereinafter, embodiments of the current mirror circuit according to the invention will be described with reference to the drawings.

(First Embodiment)

Figure 1A:
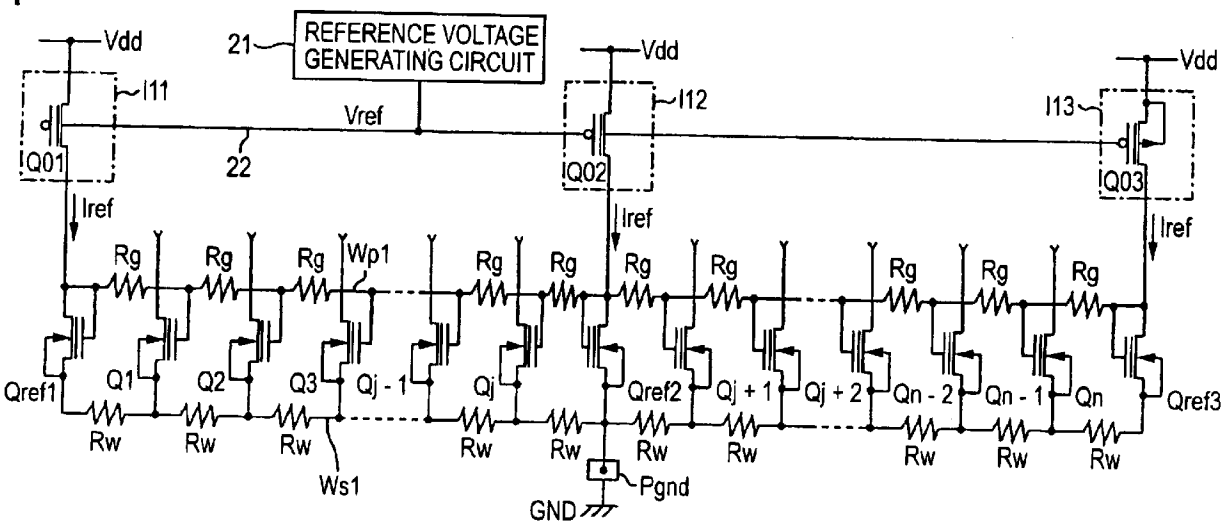
FIG. 1A is a diagram showing the configuration of a current mirror circuit which is a first embodiment of the invention.
Figure 1B:
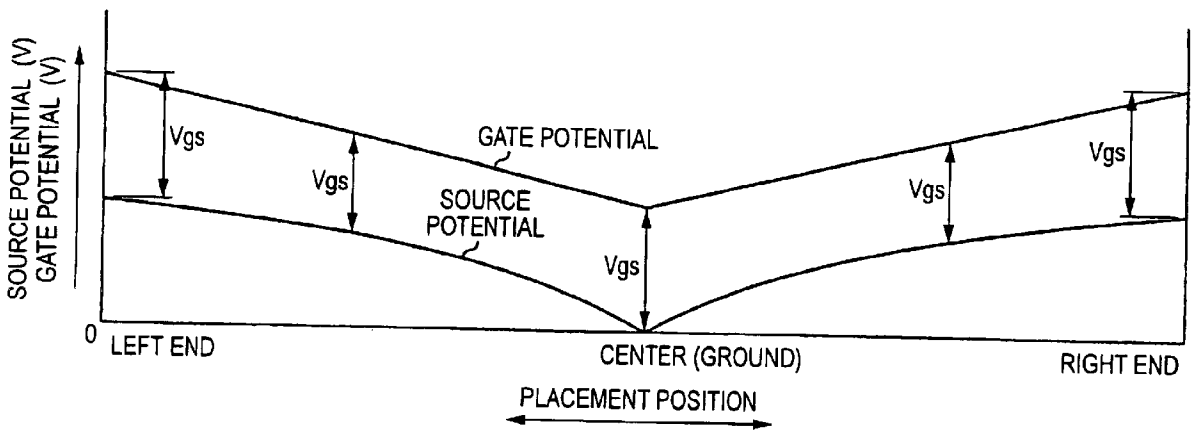
FIG. 1B is a view showing gate and source potentials in the current mirror circuit of FIG. 1A.

FIG. 1A shows the configuration of a current mirror circuit which is a first embodiment of the invention. The current mirror circuit of shown in FIG. 1A is used for supplying a constant current to a large number or hundreds of buffers in an LCD driver IC or the like, and built in an IC chip. FIG. 1B is a view showing gate and source potentials in the current mirror circuit of FIG. 1A with respect to the placement position.

Referring to FIG. 1A, input transistors Qref1, Qref2, and Qref3 of the current mirror circuit, which are NMOS, are disposed in the left end, the center, and the right end, respectively. In each of the input transistors Qref1, Qref2, and Qref3, the drain and the gate are connected to each other. The junctions between the drain and the gate of the input transistors Qref1, Qref2, and Qref3 are connected one another through a high-resistance potential line Wp1. The sources of the input transistors Qref1, Qref2, and Qref3 are connected one another through a feeder line Ws1. The source of the input transistor Qref2 in the center is connected to a ground pin Pgnd to be connected to the ground GND. The sources of the input transistors Qref1 and Qref3 in the left and right ends are not connected to the ground GND.

Constant current sources I11 to I13, which respectively have PMOSs Q01 to Q03, are connected to the drains of the input transistors Qref1, Qref2, and Qref3, respectively. A reference potential Vref generated in a reference voltage generating circuit 21 is applied to each gate of the PMOSs Q01 to Q03 through a gate signal line 22. Therefore, constant currents Iref of the same level are supplied from the constant current sources I11 to I13 to the input transistors Qref1, Qref2, and Qref3, respectively. According to the configuration, the same gate-source voltage Vgs is generated between the gate and the source of each of the input transistors Qref1, Qref2, and Qref3.

In the embodiment, the input transistors Qref1, Qref2, and Qref3 have the same size, and the constant currents Iref supplied to the transistors have the same level. However, the sizes of the transistors and the levels of the constant currents Iref are not particularly restricted as far as the gate-source voltages Vgs of the input transistors are equal in level to one another. This is applicable also to the other embodiments.

In place of disposing the common reference voltage generating circuit 21 and the gate signal line 22, the constant current sources I11 to I13 themselves may include a voltage source. Alternatively, one of the current sources, and one of the input transistors (for example, the current source I11 and the transistor Qref1) may be configured as one current mirror source circuit so as to generate a predetermined gate-source voltage Vgs. These are also applicable to the other embodiments.

Output transistors Q1 to Qj of the current mirror circuit, which are NMOS, are placed between the input transistor Qref1 in the left end and the input transistor Qref2 in the center. Similarly, output transistors Qj+1 to Qn of the current mirror circuit, which are NMOS, are placed between the input transistor Qref2 in the center and the input transistor Qref3 in the right end.

The sources of the output transistors Q1 to Qn are connected to the feeder line Ws1 and the gates of the same are connected to the potential line Wp1 at the respective placement positions of the output transistors Q1 to Qn. The drains of the output transistors Q1 to Qn are connected to respective load circuits, and the output transistors Q1 to Qn respectively operate so as to supply currents which are substantially proportional to the constant currents Iref. When the output transistors Q1 to Qn are used in a driver IC for an LCD, they serve as constant current sources for buffer circuits using a constant current.

The sources of the input transistors Qref1 to Qref3 and the output transistors Q1 to Qn are sequentially connected one another through the feeder line Ws1 having low resistance such as an aluminum wire. There is a low wiring resistance Rw between the junctions.

On the other hand, the gates of the input transistors Qref1 to Qref3 and the output transistors Q1 to Qn are sequentially connected one another through the potential line Wp1 having a high resistance. Alternatively, the gates may be connected one another via resistors of high resistance Rg, or through a polysilicon line which itself has a high resistance. In any case, it is preferable that the current flowing through the potential line Wp1 is set to a level as low as possible, and further preferably to a level which is negligible as compared with the constant currents Iref.

In the current mirror circuit of FIG. 1A, when a current flows through each of the output transistors Q1 to On, as shown in FIG. 1B, the potentials of points of the feeder line Ws1 are gradually raised in a curved manner in accordance with a product of the wiring resistance Rw and the current, as further separated from the center grounding point.

In the invention, the constant currents Iref of the same level flow through the respective input transistors Qref1 to Qref3, and hence the gate-source voltages Vgs of the input transistors Qref1 to Qref3 are equal one another and have a predetermined value as shown in FIG. 1B.

Therefore, the potentials of the potential line Wp1, i.e., the gate potentials of the output transistors Q1 to Qn are potentials on the line connecting the potential of the center grounding point (i.e., the predetermined voltage Vgs), and the potential which is obtained by adding the predetermined gate-source voltage Vgs generated in the input transistor Qref1 or Qref3 to the source potential in the left or right end. In other words, the potentials of the potential line Wp1 have a constant potential gradient.

Figure 6A:
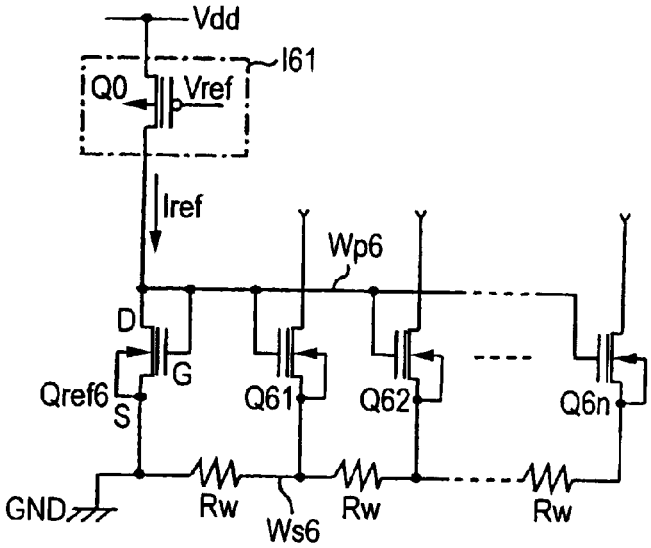
FIG. 6A is a diagram showing the configuration of a conventional current mirror circuit.
Figure 6B:
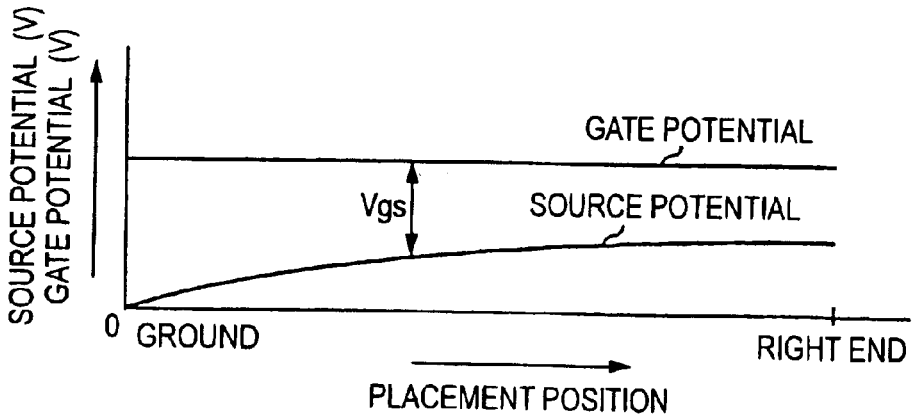
FIG. 6B is a characteristic diagram of the current mirror circuit of FIG. 6A.
Figure 7:
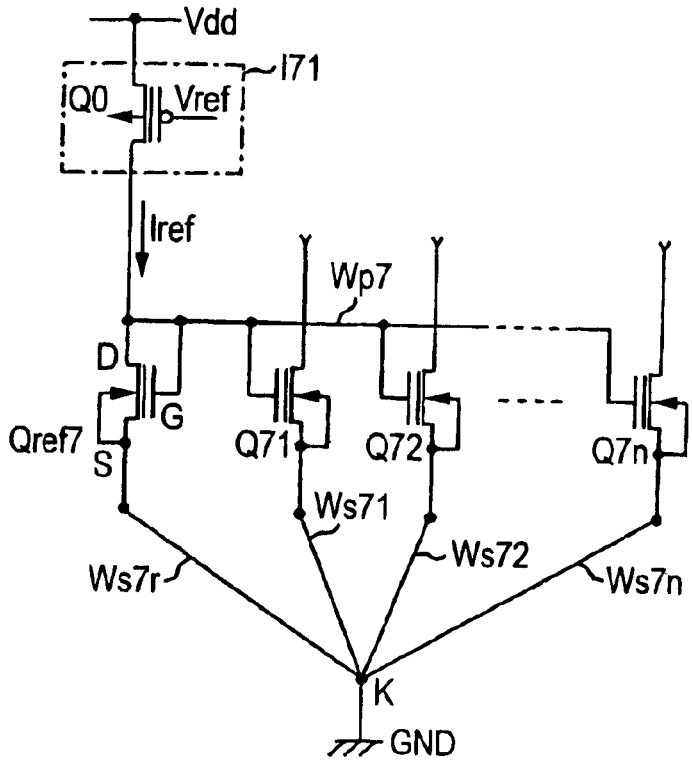
FIG. 7 is a diagram showing the configuration of another conventional current mirror circuit.
Figure 8:
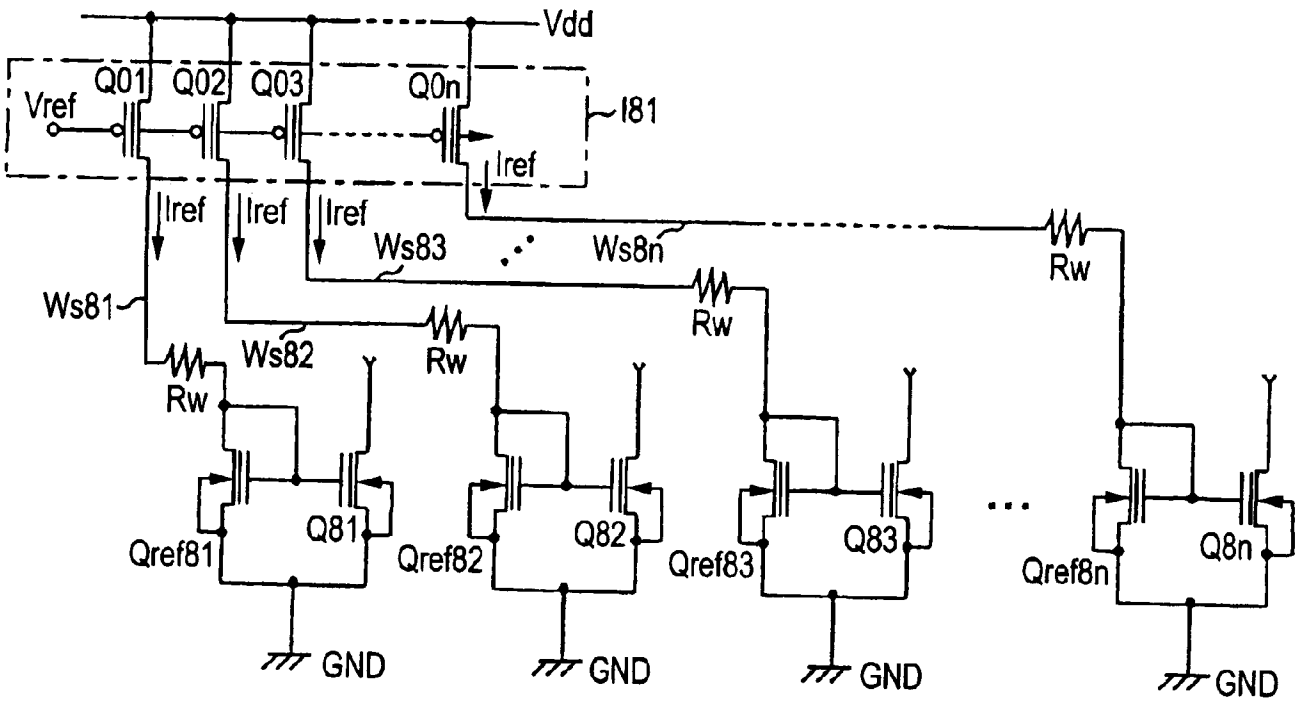
FIG. 8 is a diagram showing the configuration of a further conventional current mirror circuit.

As a result, as apparent from the comparison with the conventional art of FIG. 6, the substantially predetermined voltage Vgs is applied between the gate and the source of each the output transistors Q1 to Qn although a small error may be produced because of the curved change. Therefore, the output transistors Q1 to Qn can supply a substantially predetermined current to the respective loads. Further, unlike the prior art of FIG. 7 or 8, a influence due to the wiring resistance Rw of the feeder line Ws1 can be remarkably reduced without increasing the wiring area for forming the feeder line Ws1.

In the first embodiment of FIG. 1, also when the input transistor Qref3 and the output transistors Qj+1 to Qn on the side of the right end are omitted and only the configuration on the left side with respect to the center is used, it is possible to attain the same effects as described above.

(Second Embodiment)

Figure 2A:
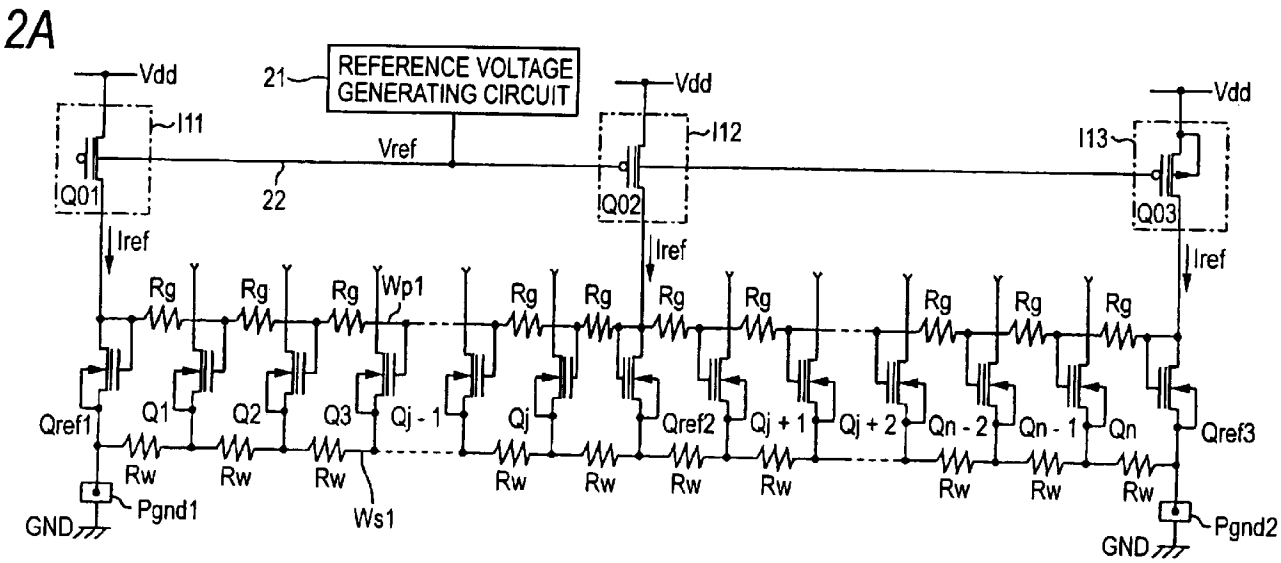
FIG. 2A is a diagram showing the configuration of a current mirror circuit which is a second embodiment of the invention.
Figure 2B:
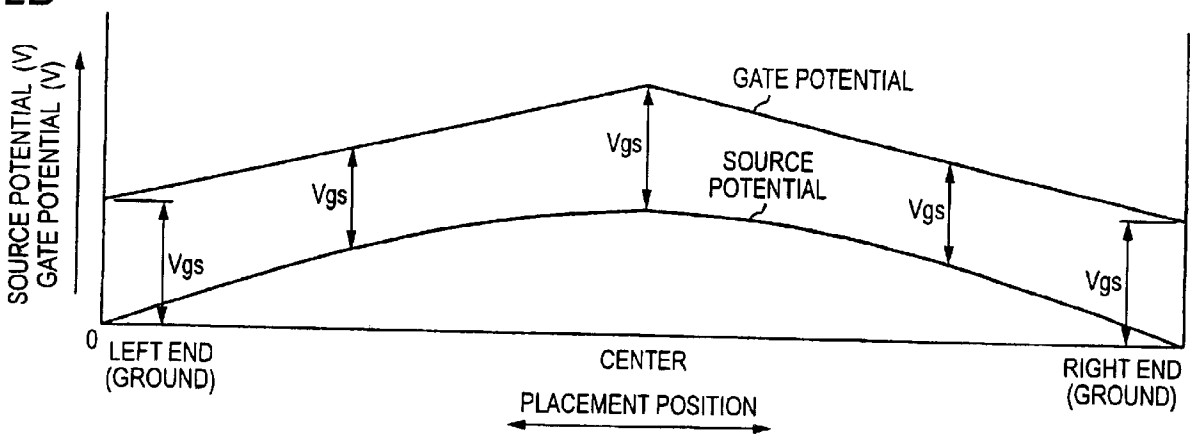
FIG. 2B is a view showing gate and source potentials in the current mirror circuit of FIG. 2A.

FIG. 2A shows the configuration of a current mirror circuit which is a second embodiment of the invention. FIG. 2B is a view showing gate and source potentials in the current mirror circuit of FIG. 2A with respect to the placement position.

In the second embodiment of FIG. 2, the sources of the input transistors Qref1 and Qref3 in the left and right ends are respectively connected to ground pins Pgnd1 and Pgnd2 to be connected to the ground GND. On the other hand, the source of the input transistor Qref2 in the center is not connected to the ground GND. In this way, the configuration of FIG. 2 is identical with that of FIG. 1 except the manner of connection (the place and the number of connections) to the ground GND.

The second embodiment can attain the same effects as those of the embodiment of FIG. 1, and further attain the following effect. Even when one of the connections to the ground is broken for any reason, or when one of the ground pins cannot be used, the gate-source voltages Vgs of all the input transistors Qref1 to Qref3 can be maintained at the predetermined value. Although The gate potential of the side where the connection to the ground is broken is raised, the whole current mirror circuit can operate without any trouble in the case where the raised gate potential is within an allowable range.

(Third Embodiment)

Figure 3A:
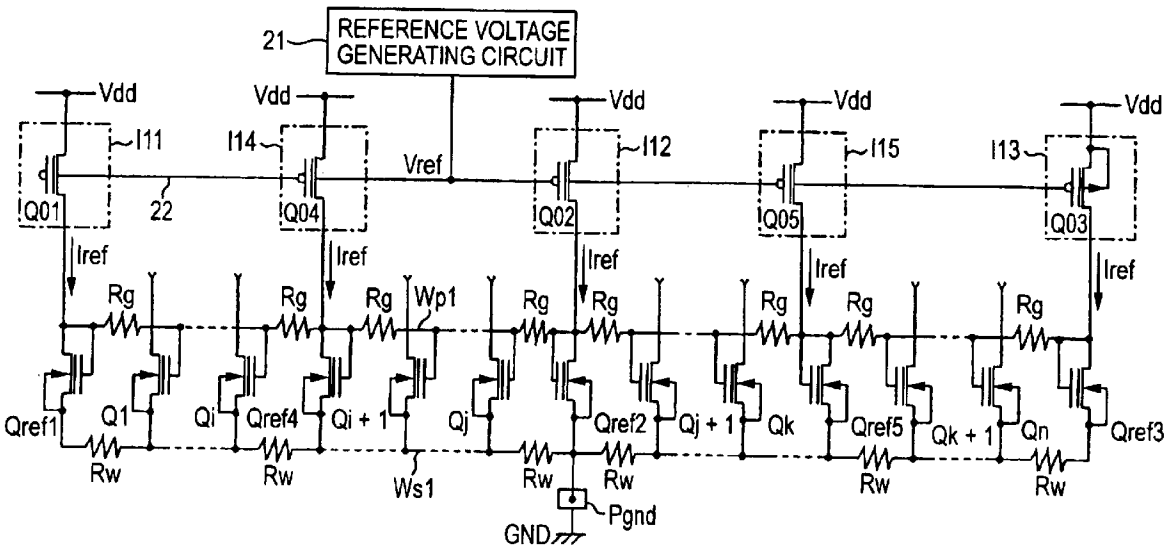
FIG. 3A is a diagram showing the configuration of a current mirror circuit which is a third embodiment of the invention.
Figure 3B:
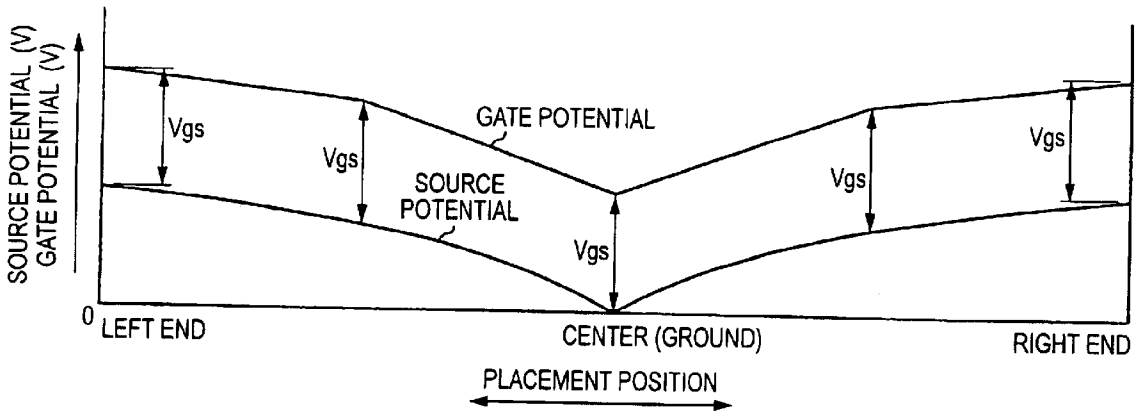
FIG. 3B is a view showing gate and source potentials in the current mirror circuit of FIG. 3A.

FIG. 3A shows the configuration of a current mirror circuit which is a third embodiment of the invention. FIG. 3B is a view showing gate and source potentials in the current mirror circuit of FIG. 3B with respect to the placement position.

The third embodiment of FIG. 3 is different from the first embodiment of FIG. 1 in the following points. A fourth constant current source I14 is disposed between the first constant current source I11 and the second constant current source I12, and a fourth input transistor Qref4 is disposed between the first input transistor Qref1 and the second input transistor Qref2. A fifth constant current source I15 is disposed between the second constant current source I12 and the third constant current source I13, and a fifth input transistor Qref5 is disposed between the second input transistor Qref2 and the third input transistor Qref3.

In the third embodiment of FIG. 3, the gate-source voltages Vgs of the forth and fifth input transistors Qref4 and Qref5 also can be maintained to the predetermined value. As shown in FIG. 3B, potential gradient in the potential line Wp1 are different between the input transistors Qref1 to Qref5.

Therefore, the third embodiment can attain the same effects as those of the first and second embodiments, and further attain the following effect. The gate-source voltages Vgs of the output transistors Q1 to Qn have a smaller error with respect to the predetermined voltage. Consequently, each current of the output transistors Q1 to Qn can be more correct level.

(Fourth Embodiment)

Figure 4A:
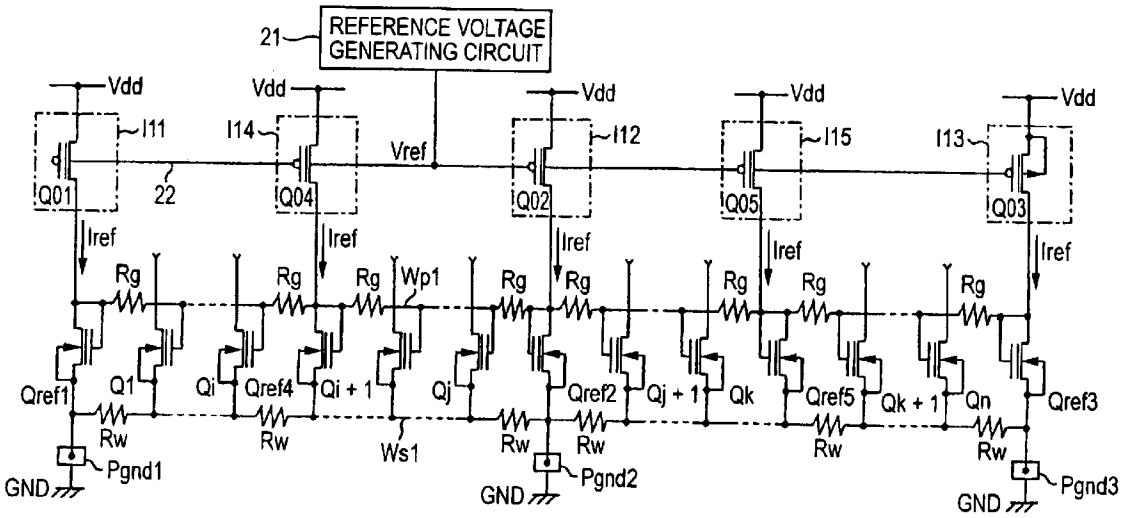
FIG. 4A is a diagram showing the configuration of a current mirror circuit which is a fourth embodiment of the invention.
Figure 4B:
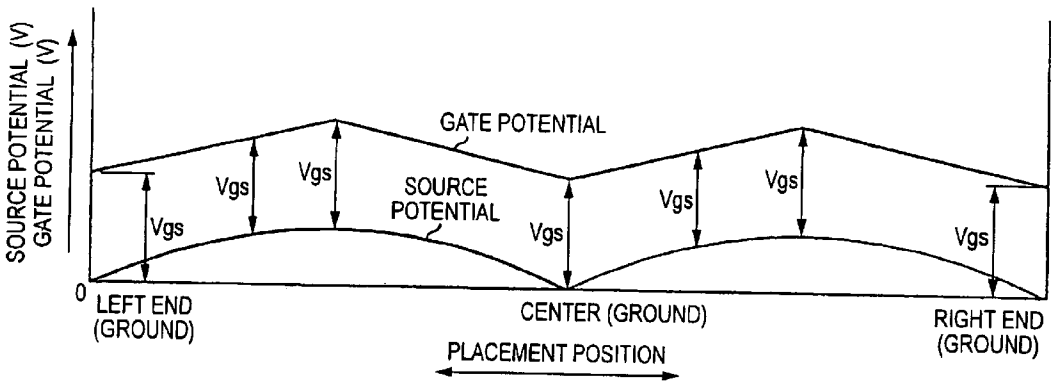
FIG. 4B is a view showing gate and source potentials in the current mirror circuit of FIG. 4A.

FIG. 4A shows the configuration of a current mirror circuit which is a fourth embodiment of the invention. FIG. 4B is a view showing gate and source potentials in the current mirror circuit of FIG. 4B with respect to the placement position.

The fourth embodiment of FIG. 4 is different from the third embodiment of FIG. 3 in the following points. The sources of the input transistors Qref1 and Qref3 in the left and right ends are connected respectively to the ground pins Pgnd1 and Pgnd2 to be connected to the ground GND. In this way, the configuration of FIG. 4 is identical with that of FIG. 3 except the manner of connection (the place and the number of connections) to the ground GND.

The fourth embodiment of FIG. 4 can attain the same effects as those of the third embodiment of FIG. 3, and further attain the following effect. As shown in FIG. 4B, the raised degrees of the gate potentials at all the placement positions can be suppressed to a small value, and hence the fourth embodiment can be effectively used even in the case where the power source voltage Vdd is low.

Figure 5:
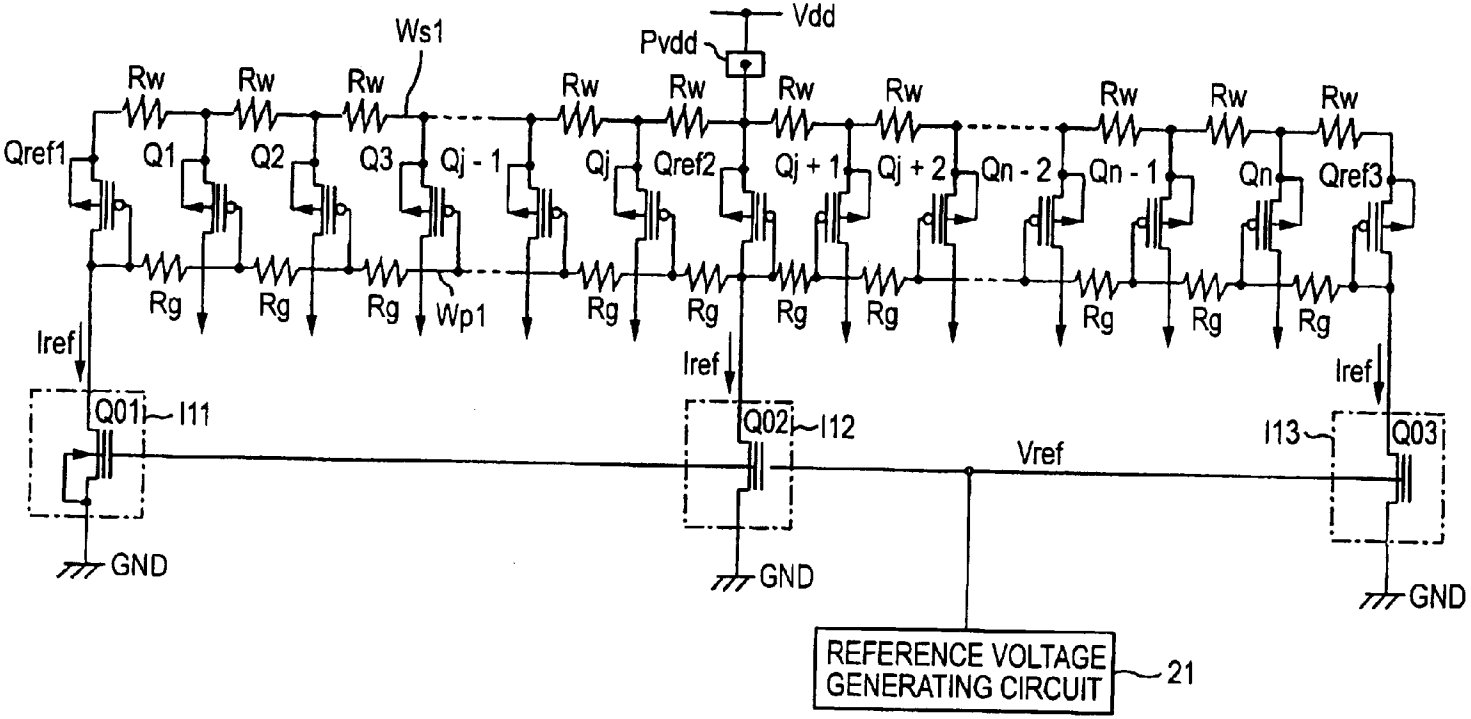
FIG. 5 is a diagram showing another configuration example of the invention.

In the embodiments described above, N-channel MOS transistors (NMOSs) are used in the current mirror circuit. Alternatively, a current mirror circuit in which P-channel MOS transistors (PMOSs) are used may be configured in the same manner. FIG. 5 is a diagram showing an example of the configuration of a current mirror circuit which corresponds to the circuit of FIG. 1A, and in which PMOSs are used. FIG. 5 is different from FIG. 1, only in that the NMOSs are replaced with PMOSs, and the voltage polarities and the current directions are reversed. The corresponding components are denoted by the identical reference numerals. The circuit of FIG. 5 operates in the same manner as that of FIG. 1. The figure "Pvdd" denotes a power source pin.

As explained above, in the current mirror circuit of the invention, a first input transistor (Qref1) whose one end is connected to a first constant current source (I11) and whose another end is connected to a reference potential (for example, the ground) is used as an input side of a current mirror. A second input transistor (Qref2) whose one end is connected to a second constant current source (I12) is disposed with being separated from the first input transistor (Qref1) by a predetermined distance and is also used as an input side of a current mirror. A plurality of output transistors (Q1 to Qj) are used as an output side of a current mirror and are distributed between the first and second input transistors (Qref1 and Qref2). According to the configuration, the gate-source voltages Vgs of the plural output transistors (Q1 to Qj) are substantially equal to those of the first and second input transistors (Qref1 and Qref2), and an influence due to the wiring resistance (Rw) of a feeder line (Ws) can be remarkably reduced without increasing the wiring area for forming the feeder line (Ws).

What is claimed is:

1. A current mirror circuit, which has a plurality of output transistors serving as current mirror outputs, comprising:

a first input transistor whose one end is connected to a first constant current source and whose another end is connected to a first connecting position at a first potential, which is used as an input side of a current mirror;

a second input transistor whose one end is connected to a second constant current source, which is disposed with being separated from said first input transistor by a predetermined distance and is used as an input side of a current mirror;

a first feeder line which connects said other end of said first input transistor with another end of said second input transistor;

a first potential line which connects said one end of said first input transistor with said one end of said second input transistor with a resistance that is higher than a resistance of said first feeder line, to produce a potential gradient; and a plurality of output transistors distributed between said first input transistor and said second input transistor, which are coupled to said first feeder line and said first potential line and are used as an output side of a current mirror.

2. The current mirror circuit according to claim 1, further comprising:

a third input transistor whose one end is connected to a third constant current source, which is disposed with being separated from said second input transistor by a predetermined distance in an opposite direction to said first input transistor and is used as an input of a current mirror;

a second feeder line which connects said other end of said second input transistor with another end of said third input transistor;

a second potential line which connects said one end of said second input transistor with said one end of said third input transistor with a resistance that is higher than a resistance of said second feeder line, to produce a potential gradient; and a plurality of output transistors distributed between said second input transistor and said third input transistor, which are coupled to said second feeder line and said second potential line and is used as an output side of a current mirror.

3. The current mirror circuit according to claim 2, wherein said another end of said third input transistor is connected to a second connecting position at the first potential.

4. The current mirror circuit according to claim 1, wherein said first potential line is polysilicon line.

5. The current mirror circuit according to claim 2, wherein said second first potential line is polysilicon line.

6. The current mirror circuit according to claim 1, wherein said first and second input transistors and said output transistors are P-channel MOS transistors.

7. The current mirror circuit according to claim 2, wherein said third input transistor is P-channel MOS transistor.

8. The current mirror circuit according to claim 1, wherein said first and second input transistors and said output transistors are N-channel MOS transistors.

9. The current mirror circuit according to claim 2, wherein said third input transistor is N-channel MOS transistor.

* * * * *